United States Patent [19]

Mutsch et al.

[11] 4,123,974

[45] Nov. 7, 1978

[54] OCEAN FLOOR MINE

[75] Inventors: Adam Mutsch, Munich; Claus Petters, Brekendorf; Helmut Grawe, Wiegersen, all of Germany

[73] Assignee: Messerschmitt-Bolkow-Blohm GmbH, Munich, Germany

[21] Appl. No.: 843,138

[22] Filed: Oct. 17, 1977

[30] Foreign Application Priority Data

Oct. 21, 1976 [DE] Fed. Rep. of Germany ..... 2647435

[51] Int. Cl.[2] ..... F42B 22/00

[52] U.S. Cl. ..... 102/13; 102/10

[58] Field of Search ..... 102/13, 15, 10

[56] References Cited

U.S. PATENT DOCUMENTS

| | | | |
|---|---|---|---|
| 3,139,032 | 6/1964 | Silverstein | 102/10 |
| 3,314,088 | 4/1967 | Nordhaus et al. | 102/13 |

FOREIGN PATENT DOCUMENTS

| | | | |
|---|---|---|---|
| 1,117,838 | 6/1968 | United Kingdom | 102/10 |

*Primary Examiner*—Charles T. Jordan

*Attorney, Agent, or Firm*—Toren, McGeady and Stanger

[57] ABSTRACT

A mine to be laid on the ocean floor consists of two separate containers joined together into a unit. One container holds a firing system and the other an explosive. The explosive is salt water resistant and of a plastic consistency. The container for the explosive is destructible so that it can be removed from about the explosive either during or after placement on the ocean floor. A flexible reinforcement member encloses the explosive so that, after the container is removed and the explosive can flow on the ocean floor, the reinforcement member holds the explosive together.

8 Claims, 2 Drawing Figures

OCEAN FLOOR MINE

SUMMARY OF THE INVENTION

The present invention is directed to an ocean floor mine and, more particularly, to a mine incorporating an electronic firing system in one container and an explosive in another container with the containers joined together into a single unit.

A mine of the above type is described in the DOS No. 2,241,537. In addition to a pressure vessel of annular cross section for the electronic firing system and a cylindrical container arranged behind the pressure vessel as it is laid on the ocean floor and containing an explosive of solid or rigid consistency. This mine includes still another device to assure that the position of the mine on the ocean floor is oriented in a particular manner, preferably parallel to the ocean floor, regardless of the depth at which the mine is laid. This device includes a ram on the explosive container face opposite the pressure vessel enclosing the electronic firing system, with the ram increasing the tilting moment of the mine. The ram is mounted in a freely fluted spring bushing with a compression spring so as to be movable in its lengthwise direction. A central recess is formed in the explosive container face for the assembly of the compression spring.

The arrangement of this mine leaves much to be desired with regard to mine sweeping safety, because when the mine rests on the ocean floor it retains its original shape and usually extends upwardly from the floor.

Therefore, it is an object of the present invention to provide a mine which affords greater mine sweeping safety.

In accordance with the present invention, such a mine includes a salt water resistant explosive of plastic consistency enclosed within a destructible container such that the explosive is exposed either during or following its placement on the ocean floor.

The ocean floor mine embodying the present invention is characterized by its particularly great mine sweeping saftey. This significant advantage is attributable to the type of explosive used and to the possibility of exposing the explosive when in place due to the special design of its container. Because of its salt water resistance, there is no objection to exposing the explosive. Another important characteristic is the spreadability of the exposed explosive, as a result of its plastic-like consistency. Under the pressure conditions available at the mine placement site the explosive will tend to spread. The ability of the explosive to flow assures its deformation into a structure best adapted to the configuration of the ocean floor, regardless of the shape of the explosive within its container. Consequently, for better storage and transportation, there is no problem in using containers for the explosive which, instead of being round or cylindrical, as has been common in the past, are straight sided or box shaped.

To displace the container from about the explosive at a desired time, it is preferably if the container is formed of a brittle material. Using a brittle material, the container can be broken apart or destructed by simple means such as firing pins or strikers.

Another possible enclosure for the explosive would be the use of a container formed of polyvinyl alcohol or a similar material which quickly dissolves in salt water. Another feature of the invention is the use of a flexible reinforcement member attached to the container holding the firing system and permanently enclosing the salt water resistance explosive. This arrangement is particularly recommended when the explosive is of the type whose flowability is so great that it would tend to separate after its exposure at the placement site under the prevailing pressure conditions.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
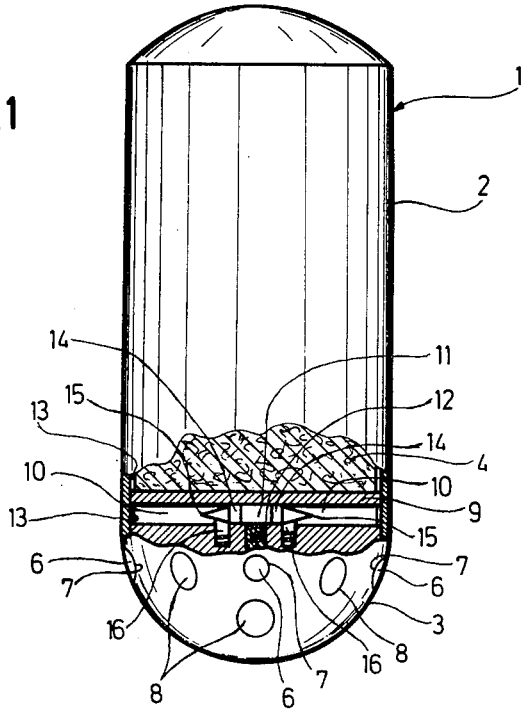
FIG. 1 is an elevational view, partly in section, of an ocean floor mine embodying the present invention and oriented in position to be laid.
Figure 2:
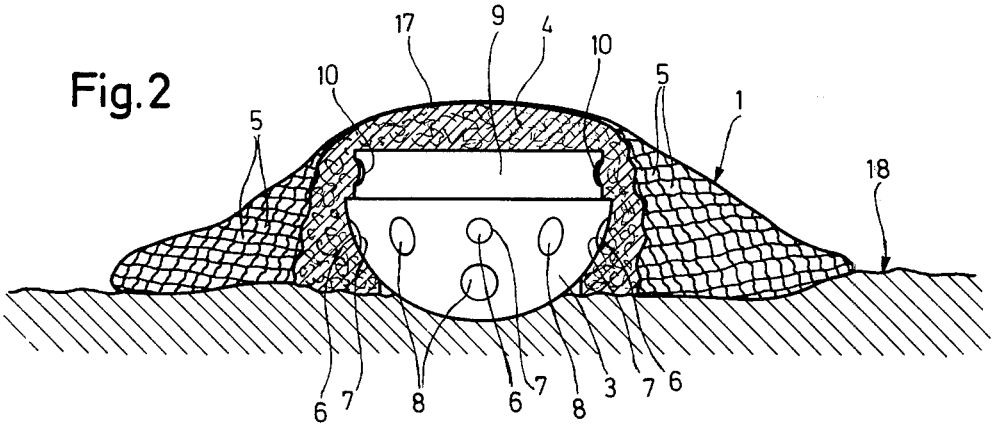
FIG. 2 is a side view, partly in section, of the mine illustrated in FIG. 1 in position on the ocean floor.

In FIG. 1 a mine 1 is shown ready to be deposited on the ocean floor. The mine 1 is formed of a first container 2 and a second container 3, detachably joined together. First container 2 is formed of a brittle material and holds a salt water resistant explosive 4 of plastic consistency. Permanently enclosing the explosive is a flexible reinforcement member 5. For reasons of clarity the reinforcement member is shown only in FIG. 2. In that figure the flexible reinforcement member is formed of a netting 5 attached to the container 3. As can be seen in FIG. 2, the flexible netting 5 moves with the plastic-like explosive as it flows on the ocean floor once its container has been broken away.

Container 3 is a pressure vessel having interior fuse channels 7 closed on the exterior of the vessel by rupturable diaphragms or membranes 6. Among other things, the pressure vessel 3 houses the entire ignition system including safety devices and sensors 8. As seen best in FIG. 2, the upper end 9 of the second container or pressure vessel 3 has a reduced outside diameter so that the adjacent end of the first container 2 fits downwardly over it. Extending radially outwardly from the center of this reduced diameter section 9 are four radially extending passages 10 opening at equidistantly spaced locations about is peripheral circumference. The radially inner ends of these passages open to a central cavity 11 into which pressurized gas from a gas cartridge 12 can be fed. At the radially outer ends of the passages 10, the container 2 is provided with predetermined breaking seams 13 extending in the longitudinal directional of the container. In the radially inner end of each passage 10 is a firing pin 14 located adjacent the central cavity and with its tip or pointed end 15 directed toward the container 2. Spring-loaded pins 16 lock the firing pins in the position shown in FIG. 1. The locking action of the pin 16 becomes ineffective the moment the firing pins 14 are rapidly accelerated in the direction of the container 2 by the pressurized gas from the gas cartridge 12, with the container 2 bursting open and being destructed upon the impact of the pointed ends 15 of the pins. With the first container 2 broken away from about the explosive 4, the plastic-like consistency of the explosive causes it to be deformed at its resting site under the pressures prevailing at that location so that it forms a structure 17 as illustrated in FIG. 2 with the explosive flowing on the ocean floor 18 and adapting to its configuration, as the explosive flows, it is restrained to some extent by the flexible reinforcement member or netting 5 so that it does not separate.

While specific embodiments of the invention have been shown and described in detail to illustrate the application of the inventive principles, it will be understood that the invention may be embodied otherwise without departing from such principles.

What is claimed is:

1. Ocean floor mine including a firing system and an explosive, a first container for said explosive, a second container for said firing system, said first and second containers being joined together into a single unit, wherein the improvement comprises that said explosive comprises a salt water resistant explosive of plastic-like consistency which is flowable, and said first container being separable from said explosive during the laying of the mine or when it is in position on the ocean floor so that said explosive is exposed to the pressure conditions on the ocean floor.

2. Ocean floor mine, as set forth in claim 1, wherein said first container for said salt water resistant explosive is formed of a brittle material, and means for breaking up said brittle material of said first container so that it is removed from around said explosive.

3. Ocean floor mine, as set forth in claim 2, wherein said means for breaking said brittle material comprises at least one firing pin arranged to impact against said first container for causing its destruction.

4. Ocean floor mine, as set forth in claim 1, wherein said first container enclosing said salt water resistant explosive being formed of one of the group consisting of polyvinyl alcohol and similar materials which are quickly dissolvable in salt water.

5. Ocean floor mine, as set forth in claim 1, wherein a flexible reinforcement member encloses said explosive permitting said explosive to flow while retaining said explosive within said member.

6. Ocean floor mine, as set forth in claim 5, wherein said flexible reinforcement member is a flexible netting.

7. Ocean floor mine, as set forth in claim 3, wherein said second container having a section arranged to fit into one end of said first container, said section having at least one radially extending passage therein, said firing pin located at the inner end of said passage, and means located within said second container for propelling said firing pin against said first container for effecting the destruction of said first container.

8. Ocean floor mine, as set forth in claim 7, including locking means for securing said firing pins in position prior to being fired.

* * * * *